US011823813B2

(12) United States Patent
Brown et al.

(10) Patent No.: US 11,823,813 B2
(45) Date of Patent: Nov. 21, 2023

(54) ROBOTIC SYSTEMS FOR LAYING OUT WIRING HARNESSES AND OTHER TYPES OF LINE HARNESSES

(71) Applicant: Wichita State University, Wichita, KS (US)

(72) Inventors: Brian Brown, Wichita, KS (US); Michael Wescott, Wichita, KS (US); Alexander VanPelt, Wichita, KS (US)

(73) Assignee: WITCHITA STATE UNIVERSITY, Witchita, KS (US)

( * ) Notice: Subject to any disclaimer, the term of this patent is extended or adjusted under 35 U.S.C. 154(b) by 0 days.

(21) Appl. No.: 17/026,189

(22) Filed: Sep. 19, 2020

(65) Prior Publication Data

US 2021/0110952 A1 Apr. 15, 2021

Related U.S. Application Data

(60) Provisional application No. 62/902,764, filed on Sep. 19, 2019.

(51) Int. Cl.
*H01B 13/012* (2006.01)
*B65C 3/02* (2006.01)

(52) U.S. Cl.
CPC ..... *H01B 13/01236* (2013.01); *B65C 3/02* (2013.01); *H01B 13/01209* (2013.01)

(58) Field of Classification Search
CPC ..... H01B 13/01236; H01B 13/01209; H01B 13/01245; B65C 3/02
See application file for complete search history.

(56) References Cited

U.S. PATENT DOCUMENTS 4,607,430 A * 8/1986 Young ..... B25J 15/00 29/33 F
4,742,612 A * 5/1988 Dokan ..... H01B 13/01245 29/760
5,826,472 A * 10/1998 Tamura ..... H01R 43/28 83/72
2007/0022600 A1* 2/2007 Furuya ..... H01R 43/20 29/842

(Continued)

FOREIGN PATENT DOCUMENTS

JP 2005235449 A * 2/2004
JP 2004119046 A * 4/2004

(Continued)

*Primary Examiner* — Peter Dungba Vo
*Assistant Examiner* — Jose K Abraham
(74) *Attorney, Agent, or Firm* — Stinson LLP

(57) ABSTRACT

A robotic system for laying out a specified wiring harness. A robotic arm is configured to arrange a plurality of wire segments along the harness support surface. A system controller is configured to direct the robotic arm to arrange each of the plurality of wire segments on the harness support surface along a specified wire route. A preparation device can label one or both ends of each wire segment as they are being laid out on the support surface. The labeler can automatically apply adhesive labels as flags at selected locations along the length of the wire segment. In a method of making a wiring harness, the robotic arm positions pins on a harness support surface to define wire routes and then arranges at least one wire segment on the harness support surface along each of the wire routes.

15 Claims, 19 Drawing Sheets

(56) References Cited

U.S. PATENT DOCUMENTS

| | | | | |
|---|---|---|---|---|
| 2013/0326868 | A1* | 12/2013 | Hisaki | H01B 13/01209<br>29/755 |
| 2018/0053584 | A1* | 2/2018 | Coviello | H01B 13/01245 |
| 2018/0088550 | A1* | 3/2018 | Kawase | B23D 33/006 |
| 2018/0366244 | A1* | 12/2018 | Rougier | H01B 13/01227 |
| 2019/0164663 | A1* | 5/2019 | Alfson | B29C 70/52 |

FOREIGN PATENT DOCUMENTS

| | | | | |
|---|---|---|---|---|
| JP | 3892919 | B2 * | 3/2007 | |
| WO | WO-2019086090 | A1 * | 5/2019 | F03D 80/85 |

* cited by examiner

ROBOTIC SYSTEMS FOR LAYING OUT WIRING HARNESSES AND OTHER TYPES OF LINE HARNESSES

CROSS-REFERENCE TO RELATED APPLICATIONS

This application claims priority to U.S. Provisional Patent Application Ser. No. 62/902,764, filed Sep. 19, 2019, which is hereby incorporated by reference in its entirety.

STATEMENT REGARDING GRANT FUNDING

This invention was made with government support under Technology Investment Agreement Number W911NF-17-3-0004. The government of the United States has certain rights in the invention.

FIELD

The present disclosure pertains to systems and methods for laying out line harnesses such as wiring harnesses.

BACKGROUND

Wiring harnesses are used on various systems and apparatuses to convey signals (e.g., electrical signals and/or power signals, electrical signals and/or optical signals) between various points/components (e.g., three or more points/components) within a system or an apparatus. The conventional process for assembling a wiring harness involves manually cutting wire segments and laying them out by hand on a support surface.

SUMMARY

In one aspect, a robotic system for laying out a wiring harness in a predefined wiring harness layout comprises a harness support surface. A robotic arm is configured to arrange a plurality of wire segments along the harness support surface. A system controller is configured to direct the robotic arm to arrange each of the plurality of wire segments on the harness support surface along a specified wire route.

In another aspect, a method of making a wiring harness comprises using a robotic arm to position a plurality of pins on a harness support surface to define a plurality of wire routes for the wiring harness and arranging, with the robotic arm, at least one wire segment on the harness support surface along each of the wire routes.

In another aspect, a robotic system for laying out a wiring harness in a predefined wiring harness layout comprises a table. A plurality of wire routing pins is supported on the table. A wire dispenser comprises a plurality of spools of wire, a labeler, and a wire cutter. A robotic arm is movable with respect to the table. A system controller is configured to direct the robotic arm to place the wire routing pins on the table to define a plurality of wire routes for the wiring harness. The system controller directs the robotic system to form a plurality of cut and labeled wire segments by: directing the robotic arm to pull a plurality of wire segments from one or more of the plurality of spools, directing the labeler to label opposite end portions of each of the plurality of wire segments using the labeler, and cutting each of the plurality of wire segments from the respective spool using the wire cutter. The system controller directs the robotic arm to arrange each of the cut and labeled wire segments along a respective one of the wire routes.

In another aspect, a robotic labeler configured to label and end portion of a wire comprises a label printer configured to print an adhesive label. The adhesive label has an adhesive side and a non-adhesive side. A label applicator is configured to apply the adhesive label onto the end portion of the wire. The label applicator comprises a label transfer member. The label transfer member comprises a distal face and a wire receiving slot opening through the distal face. The label applicator is configured to move the label transfer member from a first position to a second position. In the first position, the label transfer member opposes the non-adhesive side of the label and the label applicator is configured to connect the label to the label transfer member. The label applicator is configured to retain the label on the distal face of the label transfer member as the label applicator moves the label transfer member to the second position. The label applicator is configured to pass the end portion of the wire into the wire receiving slot as the label applicator moves the label transfer member to the second position such that label transfer member folds the label around the wire in the label receiving slot and the adhesive side of the label adheres to itself, thereby attaching the label to the end portion of the wire.

Other aspects will be in part apparent and in part pointed out hereinafter.

BRIEF DESCRIPTION OF THE DRAWINGS

Corresponding reference characters indicate corresponding parts throughout the drawings.

DETAILED DESCRIPTION

The inventors have recognized that existing procedures for laying out wiring harnesses are both resource-intensive and error-prone. This is particularly true for bespoke and low volume harness configurations. In such cases, a human technician must manually cut every wire from the correct wire source and ensure the correct wire length. The cut wire segments must then be manually labeled and laid out in accordance with the specified layout for the wiring harness. As explained more fully below, this disclosure directed to systems and methods which use one or more robots to automate some or all of the conventionally manual layout process for wiring harnesses.

The systems and methods described below mention wires and wiring harnesses. Although what follows is a description of exemplary systems and methods of forming a wiring harness, it will be appreciated that essentially the same systems and methods could be used to lay out other types of "line harnesses." Here, "line" refers simply to a physical length of material (typically flexible material) such as a wire, a cable, a tube, or a hose that can ultimately be configured to convey a signal, a material, or the like at least between a first location (e.g., first connector) at a first end of the line and a second location at a second end of the line. A "line harness" comprises plurality of lines (e.g., at least three lines, typically ten or more lines) that are laid out in a particular arrangement with respect to one another to provide predefined interfacing or connection capabilities among various components of a larger apparatus or system. Thus, a line harness in the scope of this disclosure may be formed from a plurality of wires, cables, tubes, and/or hoses, or any combination thereof. Therefore, throughout this disclosure, it will be understood that any instance of terms such as "wiring harness," "wire," and "wire segment," may be replaced with other corresponding line structure. For example, "wiring harness" could be replaced with "line harness," "cabling harness," "hosing harness," or "tubing harness." Likewise, "wire"/"wire segment" may, throughout this disclosure, be replaced with comparable terms for other types of line structure, e.g., "line"/"line segment," "cable"/"cable segment," "hose"/"hose segment," or "tube"/"tube segment."

A line harness layout includes a plurality of spaced apart termination locations (e.g., three or more, often five or more, sometimes ten or more) at which the end portions of the lines will be located in the assembled harness. In an embodiment, the layout of a line harness defines the quantities, types, and routing orientations of all of the lines extending between two termination locations of the harness.

Figure 18:
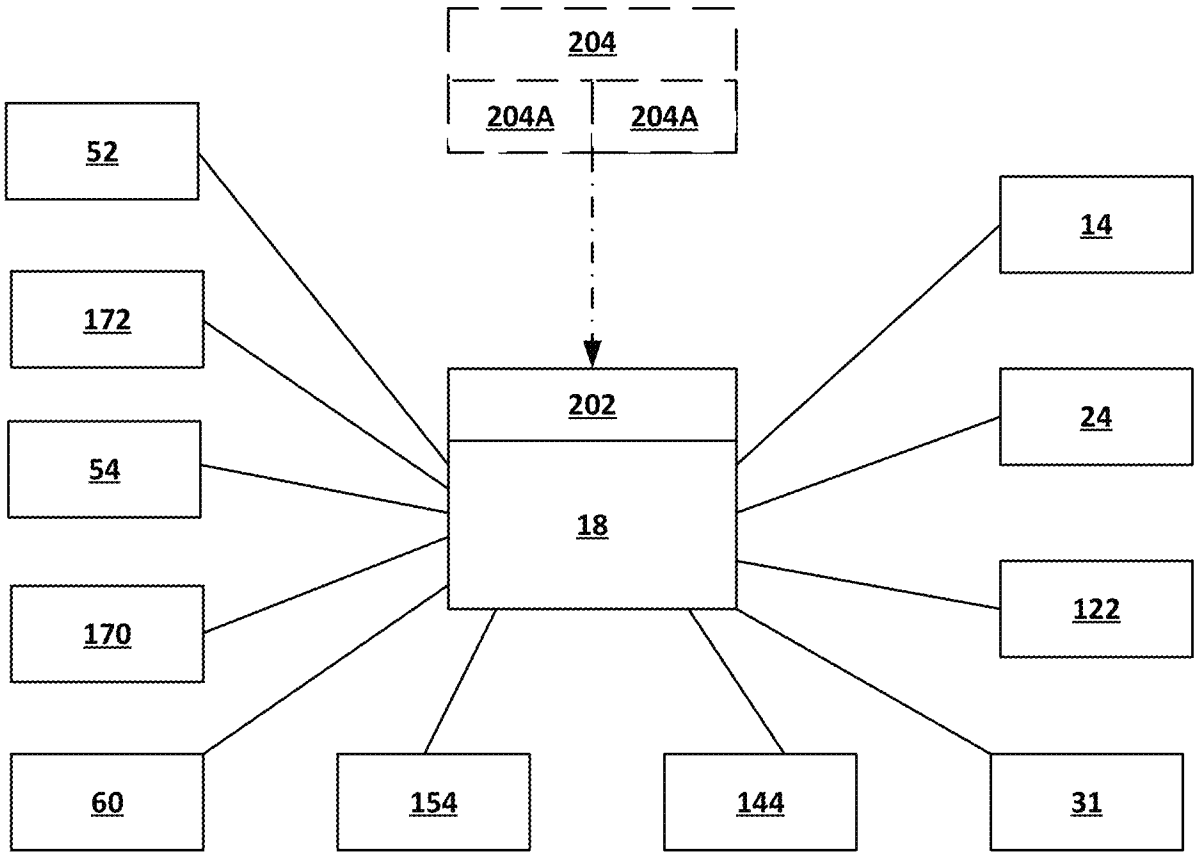
FIG. 18 is a schematic block diagram of a control system of the robotic system.

Referring to FIGS. 1-18, a robotic system for automatically laying out a wiring harness in a predefined wiring harness layout is generally indicated at reference number 10. In the illustrated embodiment, the system 10 comprises a support table 12, a robotic arm 14 configured for movement with respect to the support table, a wire dispenser 16 configured for dispensing segments of wire to the robotic arm, and a system controller 18, which can comprise one or more control processors configured to control various aspects of the system. In general, the system controller 18 (FIG. 18) is configured to direct the robotic arm 14 to take wire segments from the dispenser 16 and automatically arrange each of them on the support table 12 along a specified wire route. The arm 14 thus lays out the wire segments in the predefined harness layout, and after the harness layout is created, the users can bundle and/or connectorize the wire segments as required for the particular application. In this way, the illustrated robotic system 10 is configured as a collaborative robot—one that allows for safe human cooperation and manual input from its human operators. In other embodiments, the robotic system can have other configurations. For simplicity and clarity, the present disclosure schematically illustrates only a single control module 18 as directing the operations of the entire robotic system 10. However, as will be appreciated in view of the following technical specification, those skilled in the art will recognize the system may be integrated using more than one control processor, such as by using separate control processors for any or all of path planning, component coordination, robotic arm motion, and/or various wire dispensing operations discussed further below.

In the illustrated embodiment, the robotic system 10 is configured to lay out a wiring harness in a predefined wiring harness layout on the support table 12. More particularly, the illustrated system 10 is configured to arrange wire segments with respect to a plurality of wire routing pins 20 that the robot positions on the table at predefined positions. In one or more embodiments, the wire routing pins 20 comprise magnetic base portions. The illustrated work table 12 comprises a preparation surface 12A on which a set of the wire routing pins 20 are supported base-down in a group before being placed at defined positions by the robotic arm 14. Suitably, the preparation surface 12A is defined by one or more plates of non-magnetic material so that the pins 20 are not magnetically attracted and the robotic arm 14 can lift the pins from the preparation surface without much force or resistance.

In the illustrated embodiment, the work table 12 further comprises a harness support surface 12B adjacent to the preparation surface 12A. Suitably, the harness support surface 12B comprises one or more pieces (e.g., plates) of ferromagnetic material. The robotic system 10 is configured to place the pins 20 base-down at defined positions along the harness support surface 12B. More particularly, the arm 14 is configured to pick up individual pins 20 from the preparation surface 12 and sequentially move them to defined positions on the harness support surface 12B. The arm 14 places the pins 20 on the support surface base-down so that the pin magnets firmly retain the pins at the defined positions on the support surface 12B.

In the illustrated embodiment, the support table 12 further comprises a set of wire routing calibration posts 23 (e.g., spool-shaped posts that are freely rotatable about their axes with respect to the tabletop) at the four corners of the harness support surface 12B. The robotic arm 14 is configured to pull each wire segment around one of the respective posts 23 to establish a calibrated starting point before pulling the wire segment with respect to the wire routing pins 20 on the support surface 12B along the specified wire route. This enables the robotic system 10 to accurately predict how the trailing end of the wire segment will follow the movement of the robotic arm 14.

Figure 1:
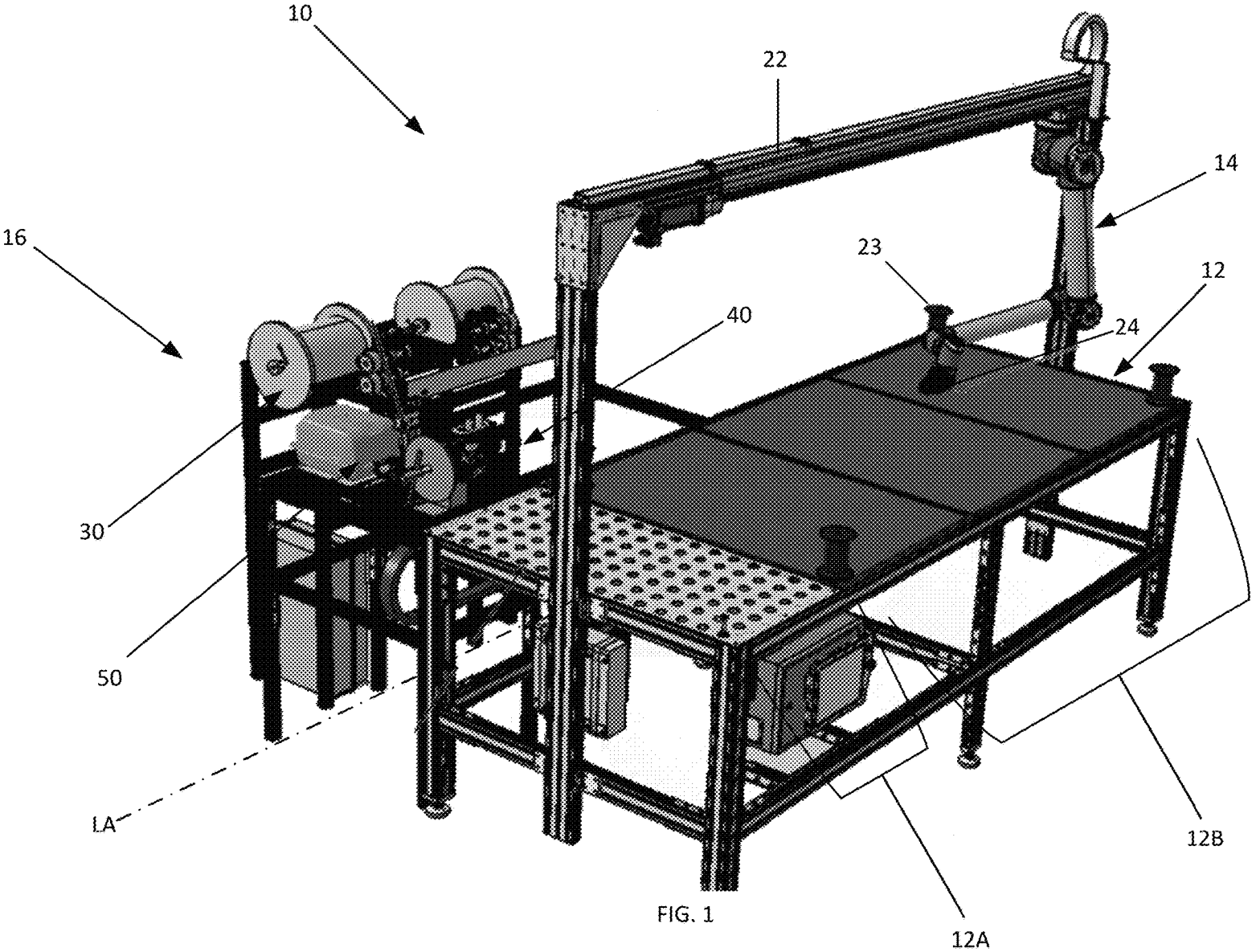
FIG. 1 is a perspective of a robotic system for laying out a wiring harness.
Figure 2:
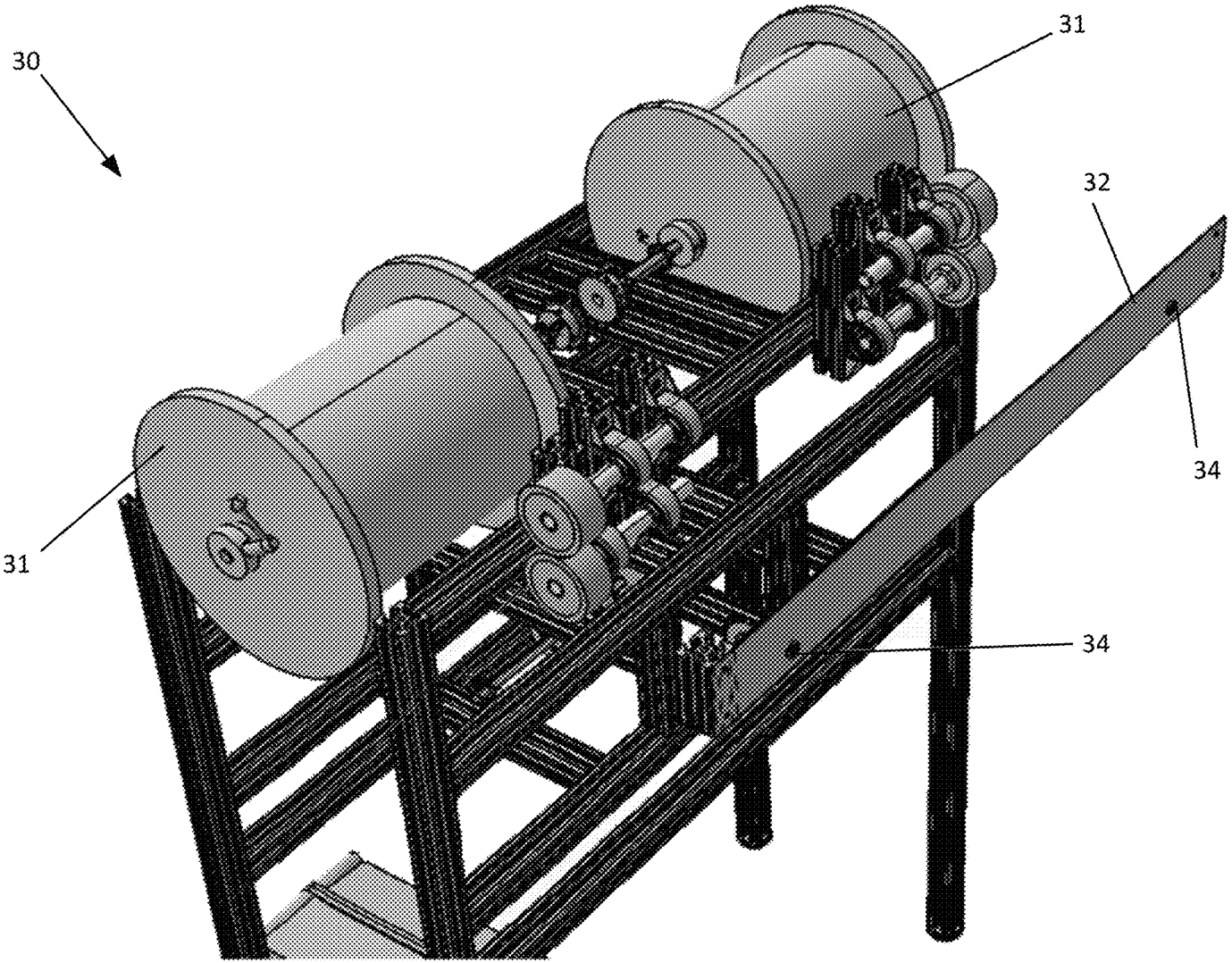
FIG. 2 is a perspective of a spool rack of the system.
Figure 6:
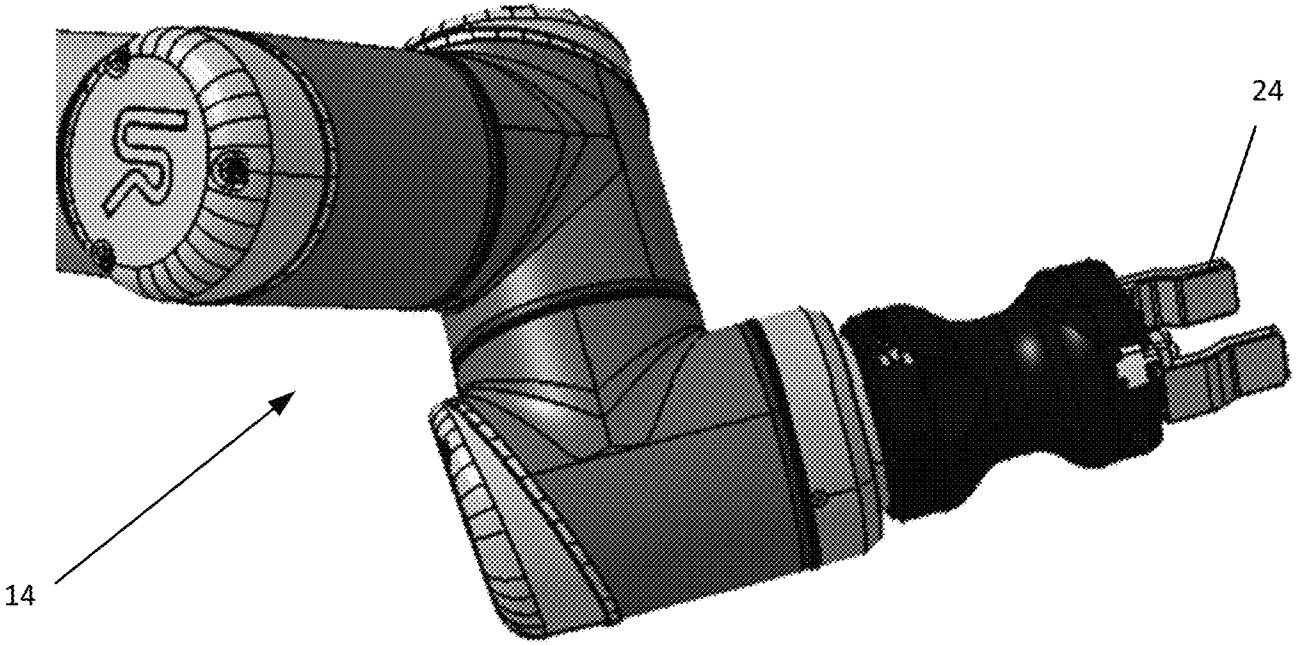
FIG. 6 is an enlarged perspective of a robotic arm of the system.
Figure 9:
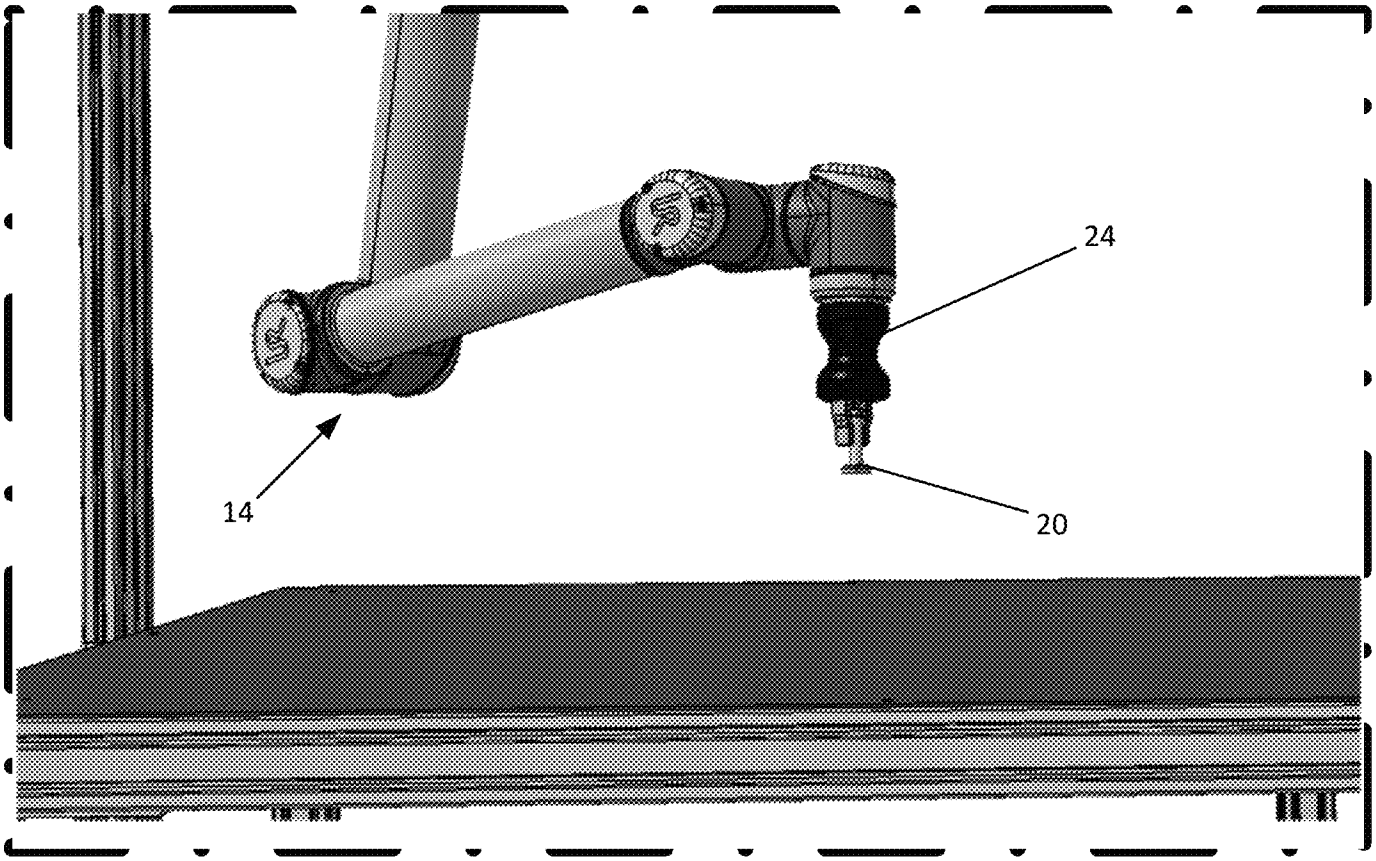
FIG. 9 is an enlarged perspective of the robotic arm positioned above the table.
Figure 10:
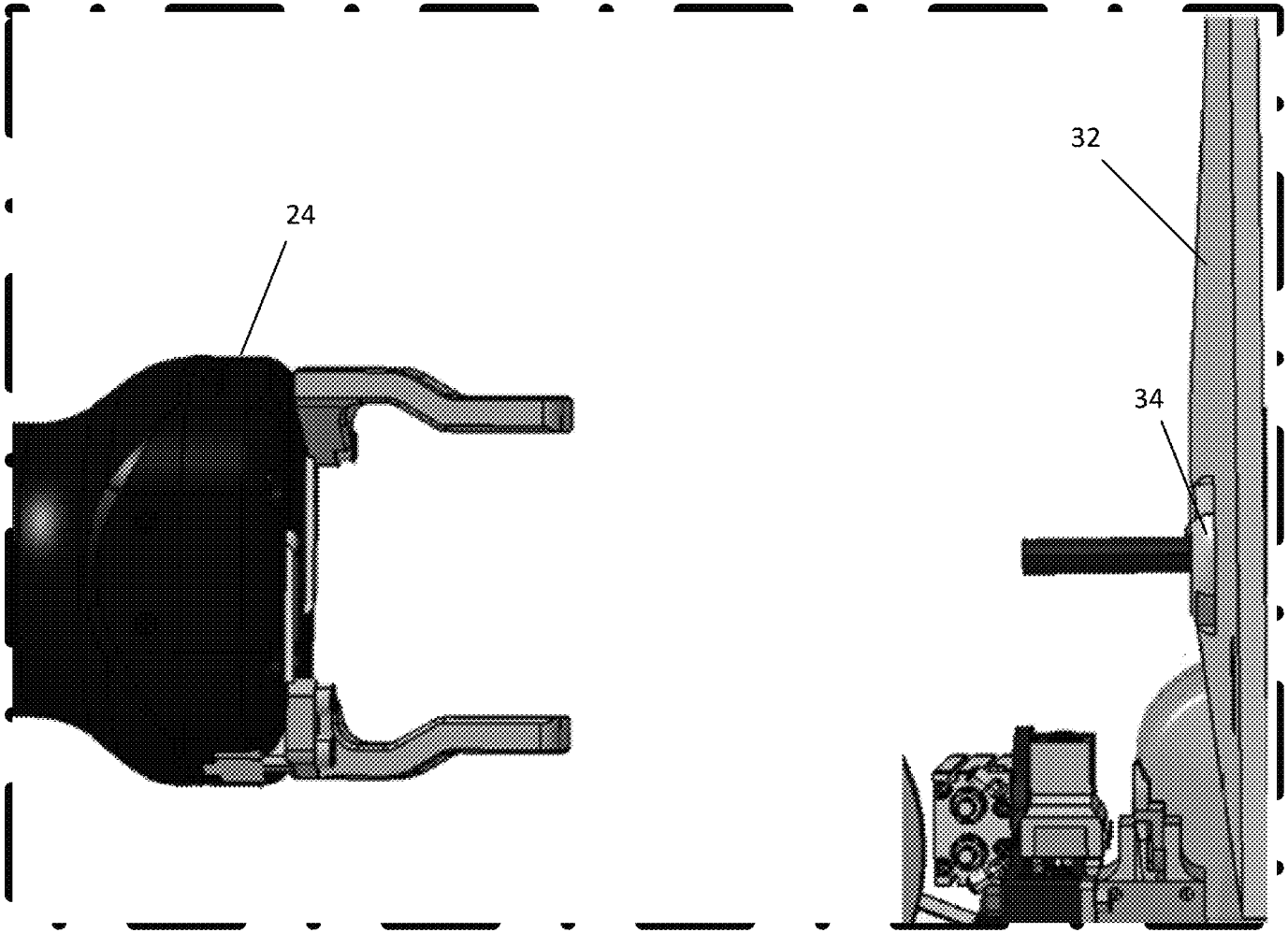
FIG. 10 is an enlarged elevation of an end effector of the robotic arm approaching a wire end protruding from a wire grommet of the spool rack.
Figure 11:
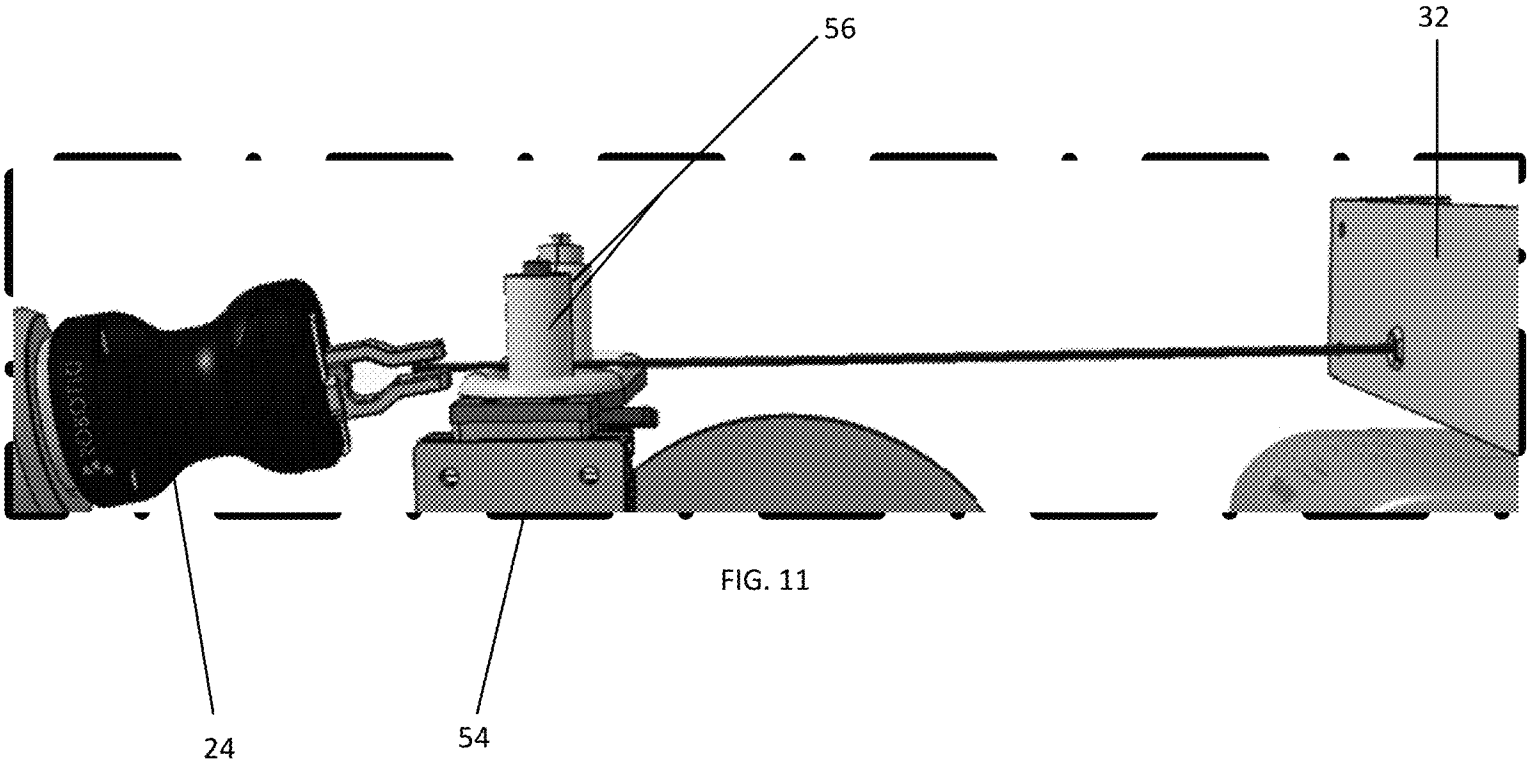
FIG. 11 is an enlarged elevation of the robotic arm pulling the wire end through an encoder of the wire preparation device.
Figure 12:
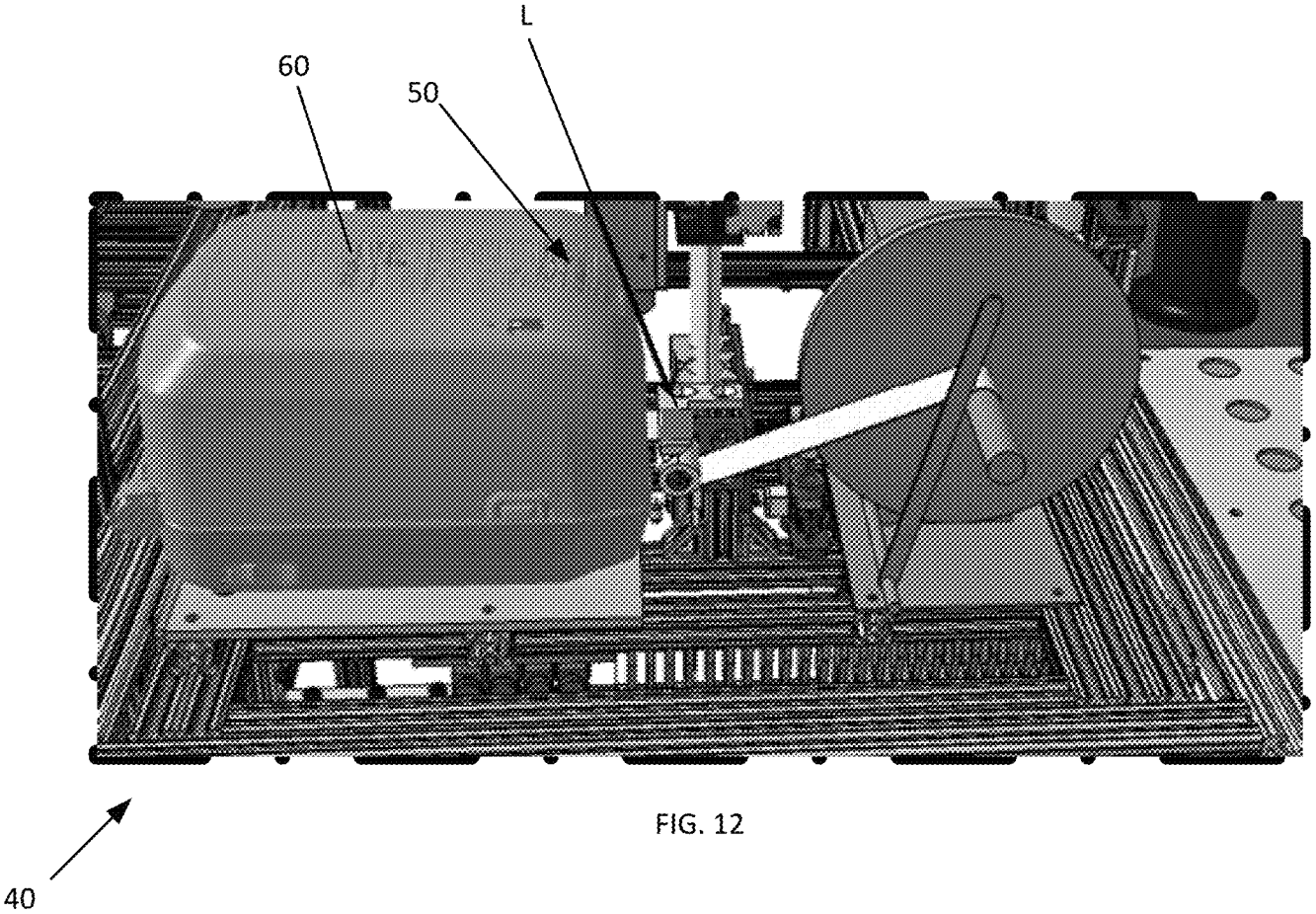
FIG. 12 is another enlarged perspective of a portion of the preparation device showing a label being printed from a label printer.

In the illustrated embodiment, the robotic arm 14 comprises a six-axis collaborative robotic arm (see FIGS. 1, 6, and 9). For example, in an exemplary embodiment, the robotic arm 14 can comprise a UR10 robot available from Universal Robots A/S. One or more end effectors 24 are operatively connectable to the distal end of the arm 14 for moving the pins 20 into position and/or manipulating the wire segments to form the wiring harness. In the illustrated embodiment, the same end effector 24 is used both for moving the pins 20 and for manipulating the wire segments. However, in other embodiments it is contemplated that different end effectors could be used for the two functions. The illustrated end effector 24 is a Hand-E adaptive gripper, available from Robotiq of Quebec, Canada. Those skilled in the art will recognize that this type of end effector is configured to grip various articles between a pair of grippers so that the robotic arm can manipulate and move the articles. Other end effectors may be also used without departing from the scope of the disclosure. In one or more embodiments, the system controller 18 comprises one or more dedicated arm control processors (not shown) that execute dedicated software (stored in memory) for controlling the articulating movement of the arm and for controlling the end effector 24.

In the illustrated embodiment, the table 12 has a rectangular shape that is elongate along a longitudinal axis LA. The robotic system comprises an overhead rail or gantry 22 that extends along the longitudinal axis LA. The robotic arm 14 is operatively connected to the rail 22 such that the entire arm can move along the rail with respect to the table 12. The rail enables the robotic arm 14 to reach the entire length of the table, and the range of motion of the robotic arm 14 at any location along the rail 22 also enables the arm to reach the entire width of the table. In an exemplary embodiment, the system controller 18 can comprise a rail control module that is configured to control a rail actuator 122 (FIG. 18) to drive movement of the arm 14 as a unit along the rail 22. Suitably, the controller 18 coordinates the rail actuator 122 with the control of the arm 14 to position pins 20 and pull wire segments along the length and width of the preparation surface 12B.

Suitably, the wire dispenser 16 is configured to selectively dispense any of a plurality of different types of wire to the robotic arm 14. In the illustrated embodiment, the wire dispenser 16 comprises a spool rack 30 (FIG. 2) which holds a plurality of motorized wire spools 31, each containing a different type of wire. The wire dispenser 16 further comprises a wire grommet manifold 32 comprising a plurality of wire grommets 34 which hold the free end portions of each wire spool. In the illustrated embodiment, the end effector 24 is configured to grip the free wire end portion protruding through a grommet 34 and then pull wire from the respective spool 31 through the grommet (see FIGS. 10 and 11). The grommet manifold 32 is configured to space the free end portions of the wires so that the end effector 24 can grasp any of the wires. In one or more embodiments, the wire grommet manifold 32 includes wire grommets 34 at spaced apart locations along the longitudinal axis LA. This enables the wire dispenser 16 to selectively move other equipment along the longitudinal axis LA to a plurality of longitudinally spaced positions corresponding to each of the grommets 34.

Figure 3:
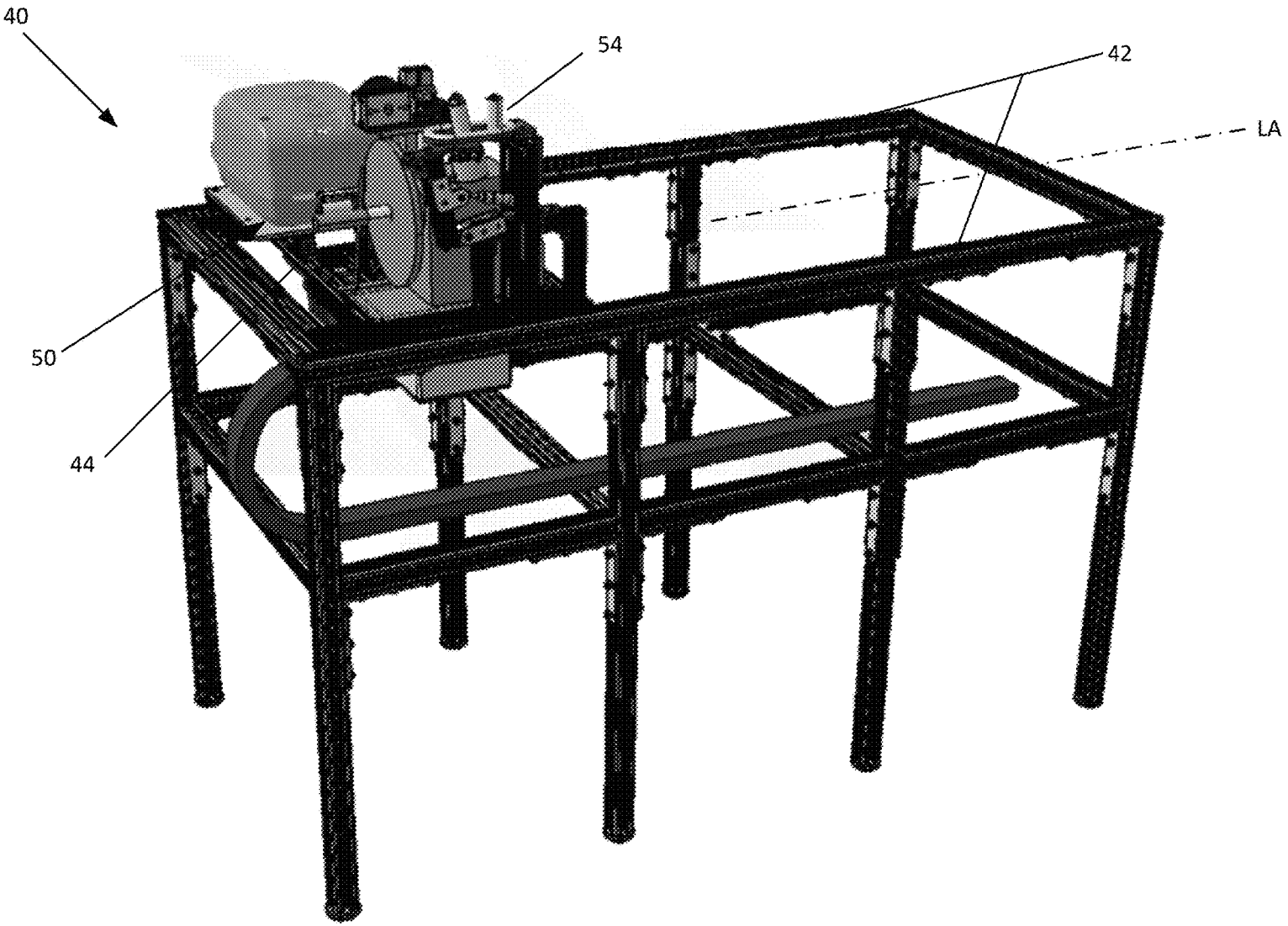
FIG. 3 is a perspective of a wire preparation device of the system.
Figure 4:
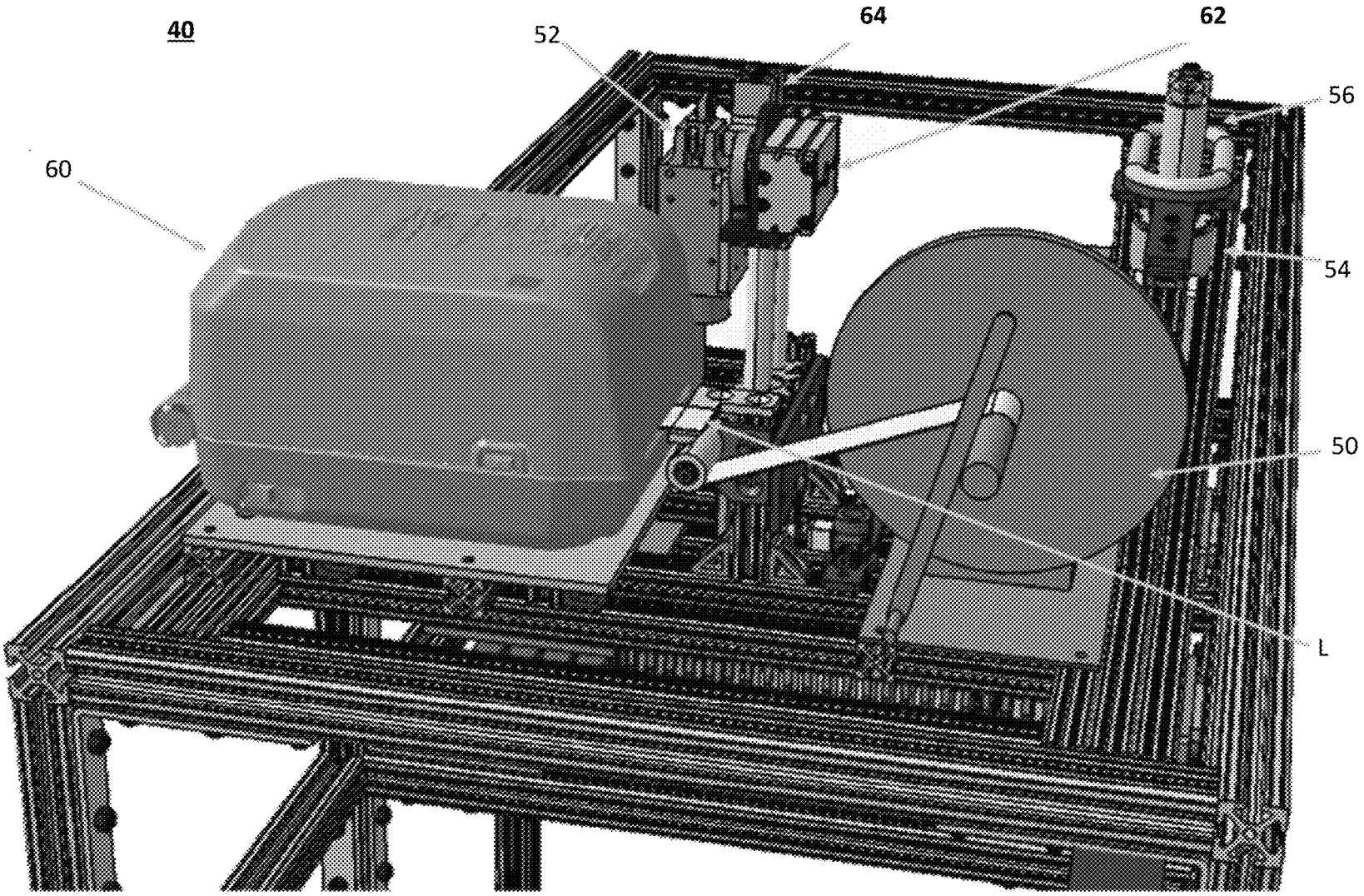
FIG. 4 is an enlarged perspective of a portion of the preparation device.
Figure 5:
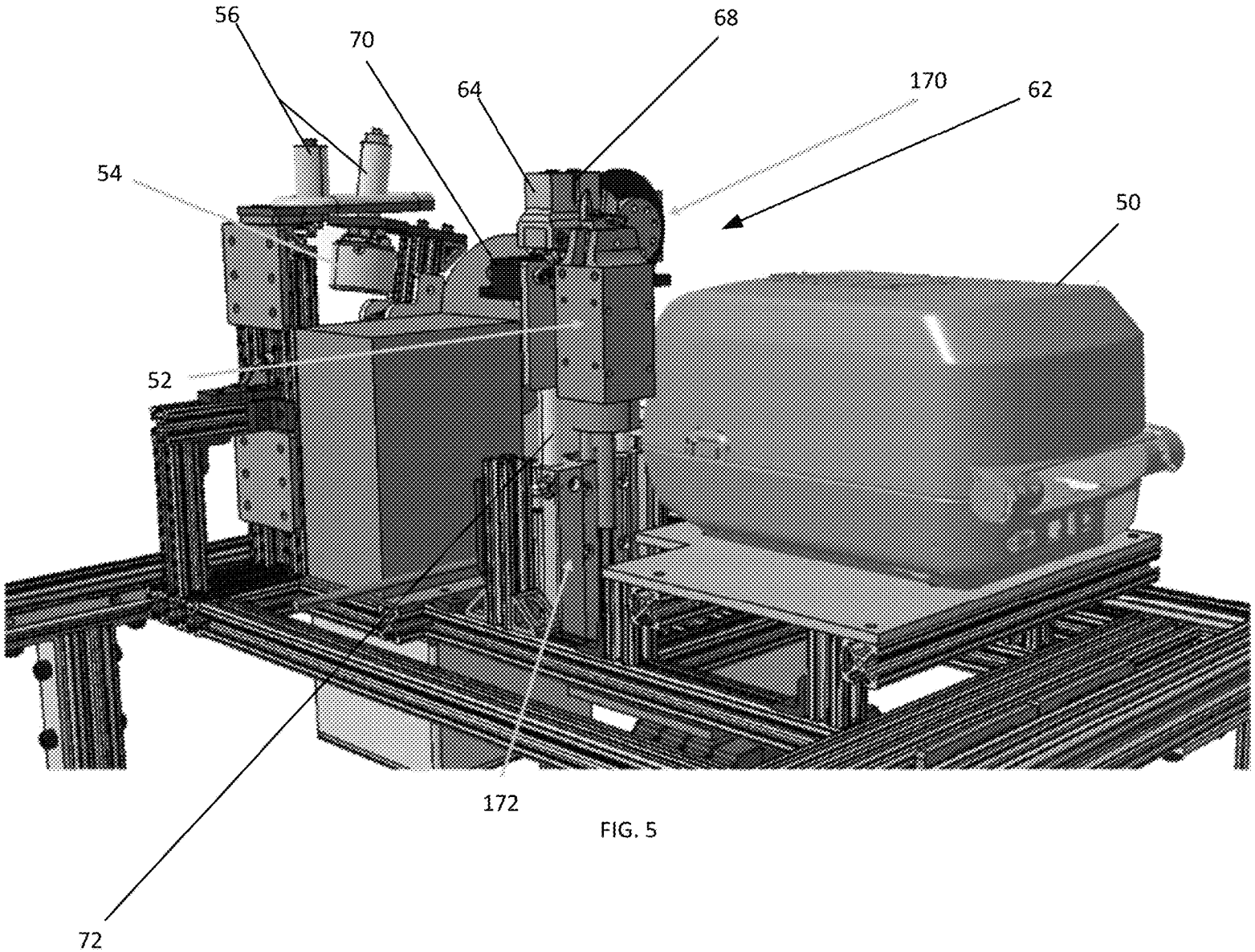
FIG. 5 is another enlarged perspective of a portion of the preparation device.

In the illustrated embodiment, the wire dispenser 16 further comprises a wire preparation device 40 (see FIGS. 3-5). The wire preparation device comprises one or more rails 42 connected to the spool rack 30 and the table 12 to extend generally along the longitudinal axis LA. A carriage 44 is connected to the rail 42 for movement along the rail and relative to the spool rack 30. Suitably, the dispenser 16 comprises a carriage driver 144 (FIG. 18) configured to automatically drive movement of the carriage 44 along the rail 42. As explained more fully below the system controller 18 is configured to coordinate the carriage driver with the other actuatable components of the robotic system 10 to automate the wiring harness layout process. As will also be explained more fully below, the movement of the carriage 44 along the rail 42 enables the wire dispenser 16 to use wire from any of the spools 31 supported on the spool rack 30.

The wire preparation device 40 further comprises a labeler 50, a wire cutter 52, and an encoder 54 (broadly, a wire segment length measurement sensor) supported on the carriage 44 for movement with the carriage along the rail 42. During use of the wire dispenser 16, the system controller 18 is configured to direct the carriage driver 144 to move the wire preparation device 40 along the longitudinal axis LA into operative alignment with a respective one of the grommets 34 that holds wire of the type required for the wire segment currently being prepared. When the carriage 44 is operatively aligned with the correct grommet 34, the system controller 18 directs the end effector 24 to grip the protruding wire end and then pull it between two rollers 56 of the encoder 54. In the illustrated embodiment, an encoder actuator 154 (FIG. 18) is configured to selectively move the rollers 56 between an open position (shown in FIG. 5) and a closed position (not shown). The actuator 154 can selectively move one or both of the rollers 56 to bring them together against opposing sides of the wire so that the rollers roll as the arm 14 pulls wire from the spool 31. For each wire segment prepared, the system controller 18 directs the arm 14 to position the wire between the rollers 56 while they are open and then directs the actuator 154 to close the rollers so that the encoder 54 can detect the length of wire that the arm subsequently pulls as a function of the rolling of the rollers.

In the illustrated embodiment, the wire preparation device 40 is generally configured to label each end portion of each wire segment that is cut from the spools 31. The illustrated labeler 50 comprises a flag labeling system that is configured to apply adhesive flag labels to each end portion of each wire segment, as described more fully below. It is also contemplated that other types of wire labeling devices may be used without departing from the scope of the disclosure. For example, it is expressly contemplated that a laser marking labeler could be used of the type that is available from Nova systems. The illustrated labeler 50 comprises a label printer 60 and a label applicator 62. The label printer 50 is configured to automatically print adhesive labels L (e.g., with identifying information about the wire being prepared) as directed by the system controller 18. In the illustrated embodiment the label printer 50 is configured to print the labels L so that the adhesive side of each label faces down and the non-adhesive side of the label faces up (see FIG. 12).

Figure 13:
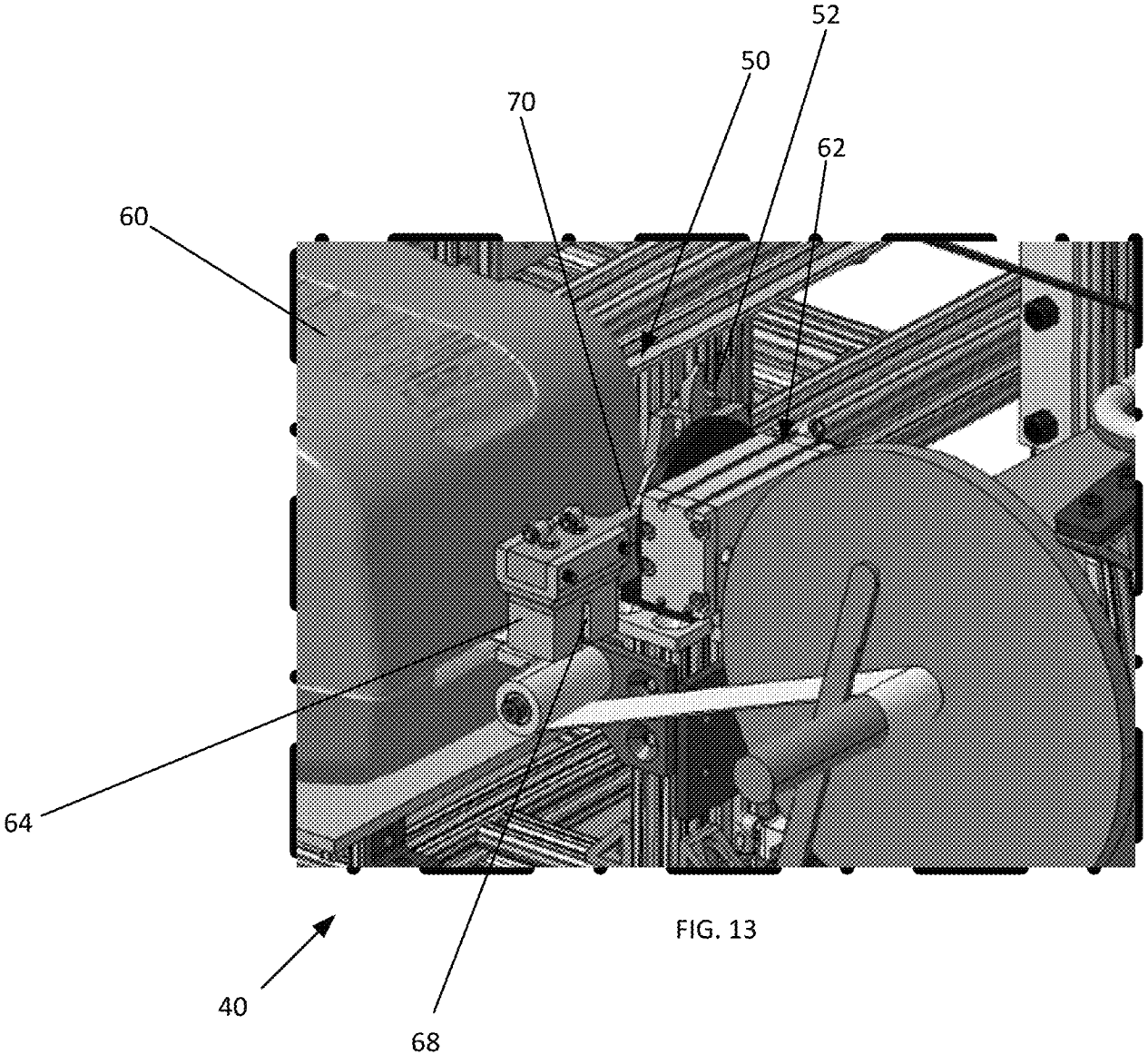
FIG. 13 is another enlarged perspective of a portion of the preparation device showing a label applicator in a first end position of its range of motion.
Figure 14:
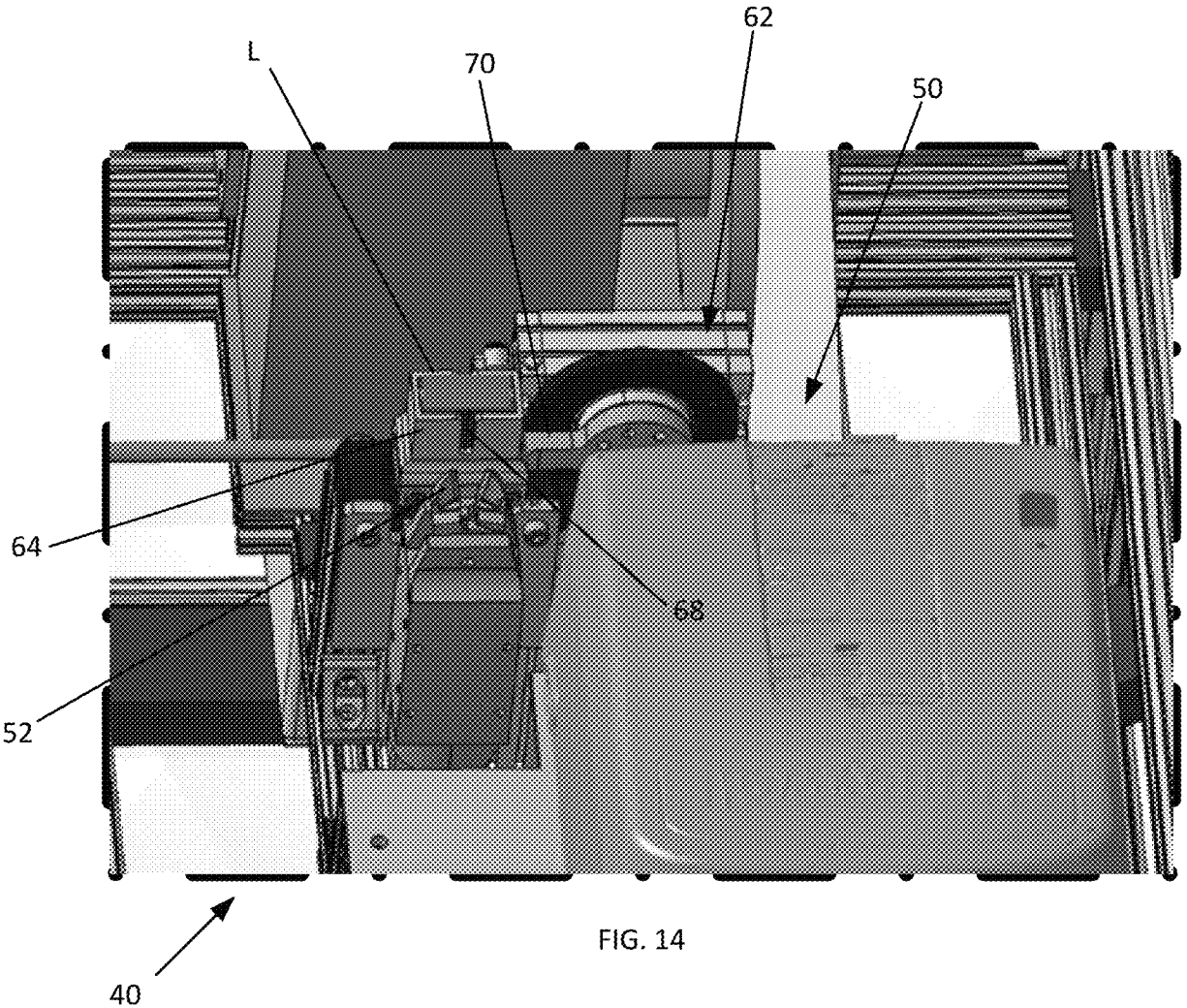
FIG. 14 is another enlarged perspective of a portion of the preparation device showing a rotatable applicator arm of the label applicator rotating away from the position in FIG. 14.
Figure 15:
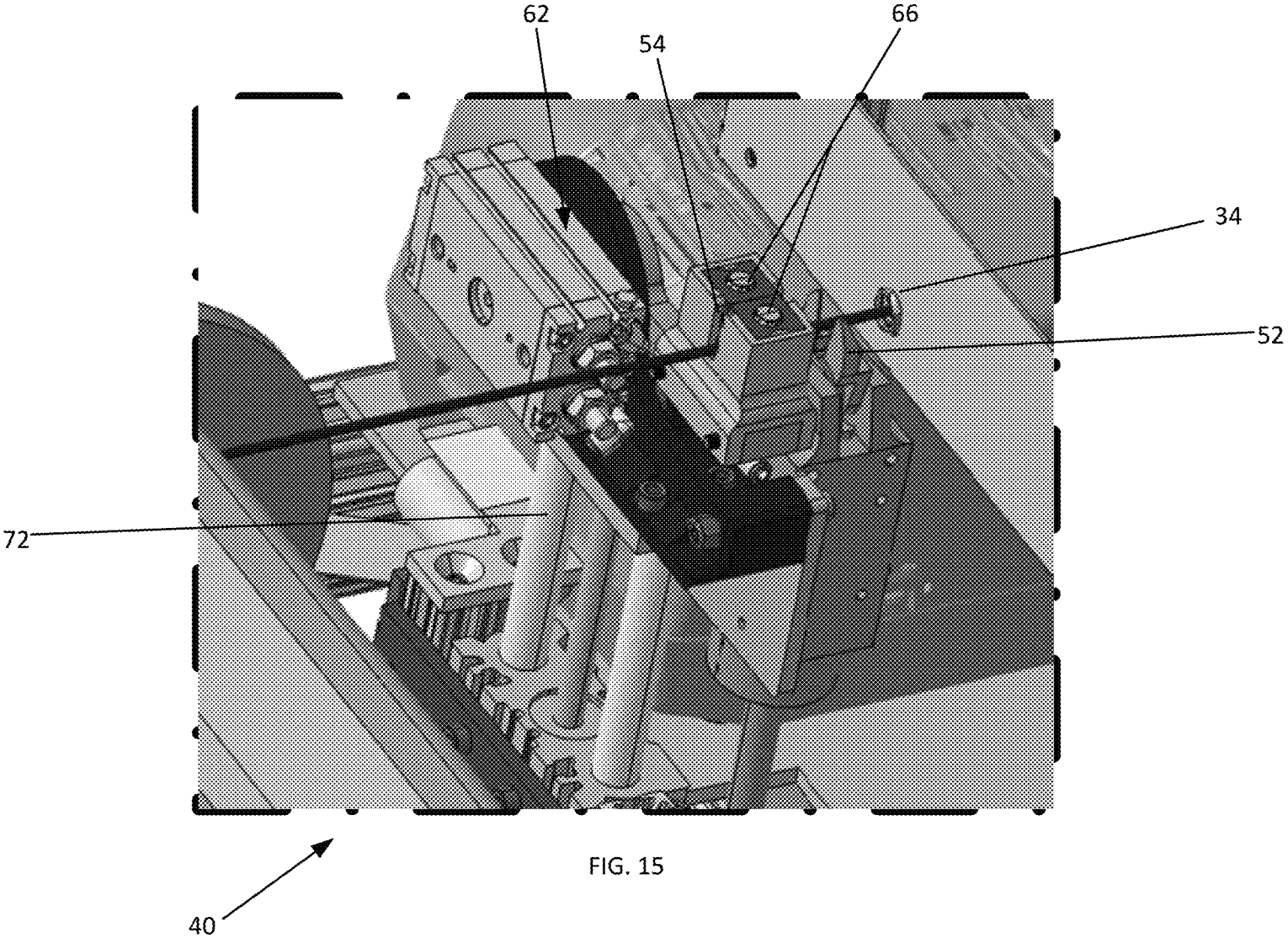
FIG. 15 is another enlarged perspective of a portion of the preparation device showing a slide arm of the label applicator raised from the position shown in FIGS. 13 and 14 to a raised position and showing the label applicator at a second end position of the range of motion.
Figure 16:
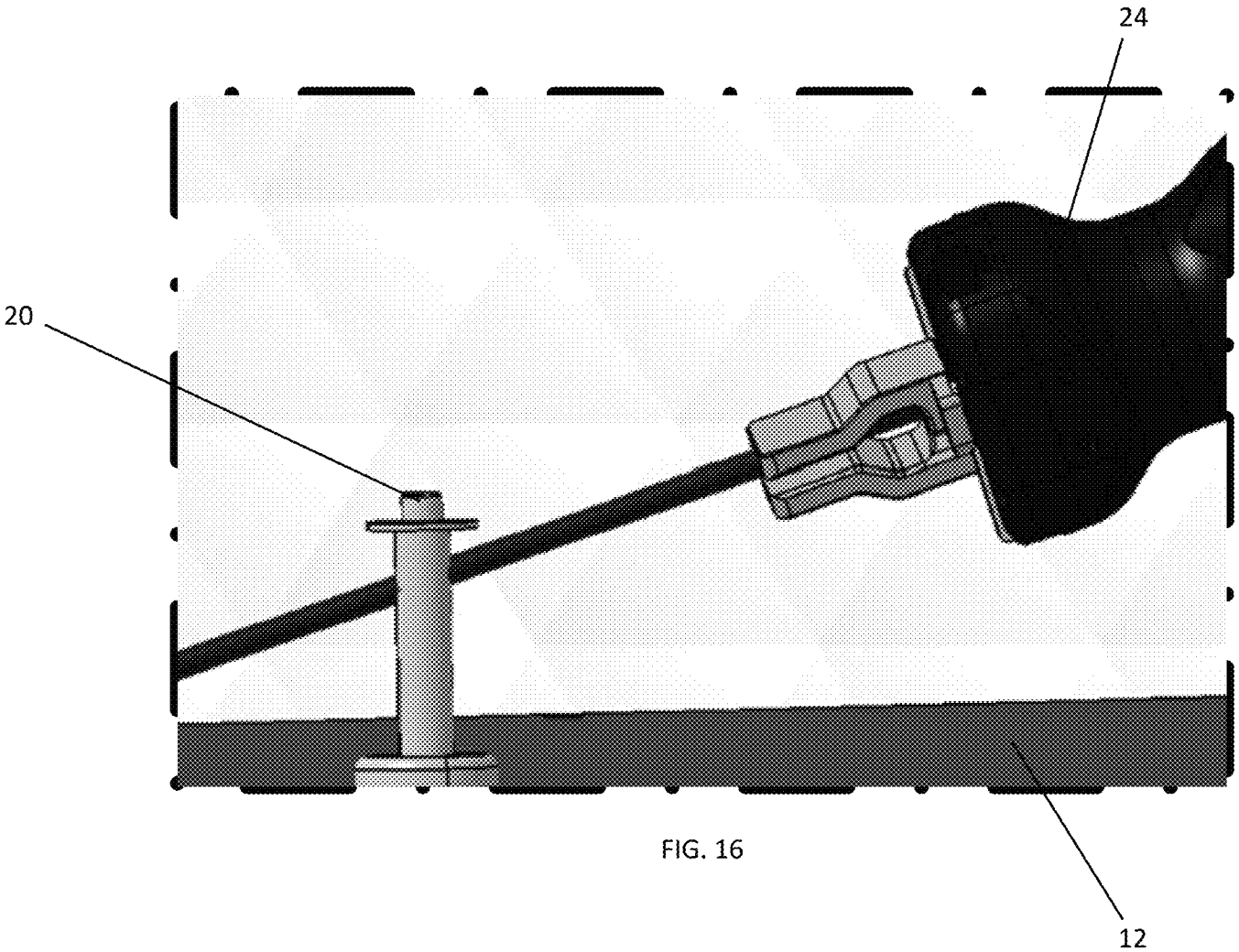
FIG. 16 is an enlarged elevation showing the end effector pulling the wire along a specified wire route in relation to a wire routing pin.
Figure 17A:
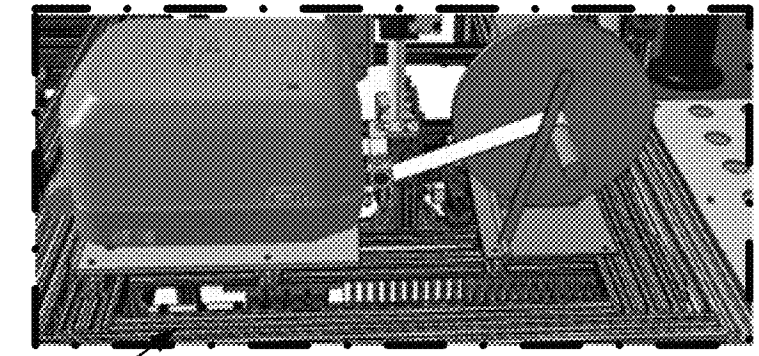
FIGS. 17A-17D are a series of enlarged perspectives of portions of the preparation device showing a sequence of operations in which the preparation device applies a label to a trailing end portion of a wire segment and cuts the wire segment to length.
Figure 17B:
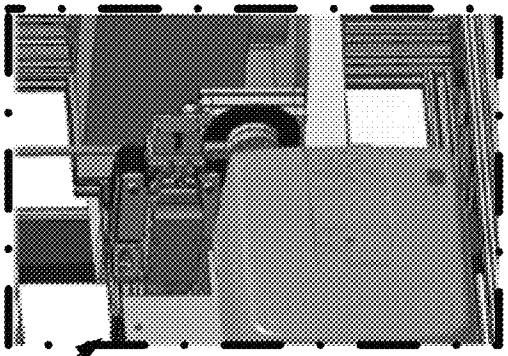
Figure 17C:
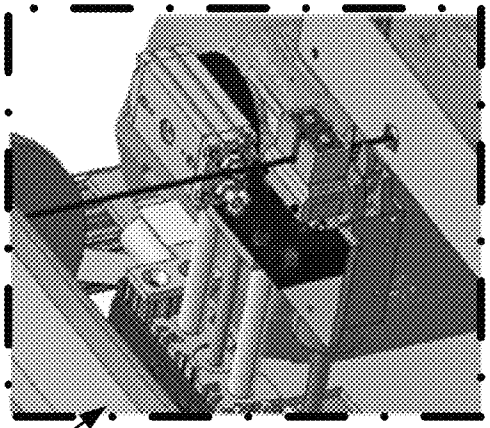
Figure 17D:
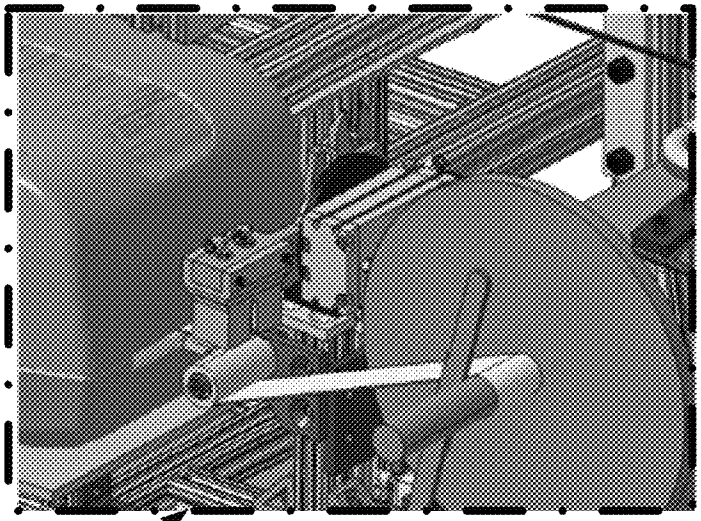

The label applicator 62 is selectively movable with respect to the label printer 60 and the wire being pulled by the robotic arm 14 through a range of motion that includes a first end position (FIG. 13) at which the label applicator is configured to pick up an adhesive printed label L from the label printer to a second end position (FIG. 15) at which the label applicator is configured to adhere the printed label onto the respective wire segment as a flag-type label. In the illustrated embodiment, the label applicator 62 comprises a label transfer member 64 (e.g., a block) that has a distal face which defines one or more vacuum ports 66. The transfer member 64 further comprises a wire receiving slot 68 that opens through the distal face. The proximal end portion of the transfer member 64 is connected the distal end portion of a rotatable applicator arm 70 and the proximal end portion of the rotatable applicator arm is connected to the distal end portion of a slide arm 72. A rotational actuator 170 (FIG. 18) is configured to rotate the rotatable applicator arm 70 with respect to the distal end portion of the slide arm 72 between a first rotational orientation in which the transfer member 64 is turned distal-face-down (FIG. 13) and a second position in which the block is turned distal-face-up (FIGS. 14-15). A linear actuator 172 (FIG. 18) is configured to slide the slide arm 72 between a lowered position (FIG. 14) and raised position (FIG. 15). In the first end position of the range of motion of the applicator 62 (FIG. 13), the rotatable applicator arm 70 is in the first rotational position and the slide arm 72 is in the lowered position. In the second end position of the range of motion of the applicator 62 (FIG. 15), the rotatable applicator arm 70 is in the second rotational position and the slide arm 72 is in the raised position.

To apply a label L after it has been printed by the label printer 60, the system controller 18 directs the applicator 62 to perform the following operations in sequence. During this process, the motorized spool 31 (e.g., a clutch mechanism associated with the motorized spool) locks to hold tension in the wire while the label L is being applied. The applicator 62 moves to the first end position of the range of motion as shown in FIG. 13, where the distal face of the transfer member 64 is facedown above the non-adhesive side of the printed label L. The applicator 62 then draws a vacuum through the vacuum ports 66 to retain the non-adhesive side of the label L against the distal face of the transfer member 64. The rotational actuator 170 then rotates the rotatable applicator arm 70 from the first rotational position to the second rotational position as shown in FIG. 14 (label is now adhesive-side-up). The linear actuator 172 then raises the slide arm 72, which moves label L toward the wire until the adhesive side of the label L engages the wire and the wire passes into the slot 68 as shown in FIG. 15. This causes the label L to fold around the wire and adhere to itself, thereby applying the label as a flag to the wire.

As will be explained in further detail below, in an exemplary embodiment, the system controller 18 is configured to direct the labeler 50 to label each end of each wire segment used in a wiring harness laid out by the system 10. In the illustrated embodiment, the wire cutter 52 comprises powered clippers that are coupled to the slide arm 72 for movement with the slide arm between the lowered and raised positions. Raising the slide arm 72 positions the powered clippers 52 for cutting a wire segment at the trailing end. Thus, in one or more embodiments, the system controller 18 is configured to actuate the powered clippers after directing the labeler 50 to label the trailing end portion of the wire. For example, the system controller 18 can actuate the clippers 52 to cut the trailing end of the wire before the slide arm actuator 172 lowers the arm from the raised position.

In the illustrated embodiment, the system controller 18 is configured to execute a wiring harness layout automation engine 202 that automatically determines a complete sequence of motions for the robotic system 10 based on a harness model 204 that defines certain constraints of the predefined wiring harness layout. The layout automation engine 202 may comprise processor-executable software stored in memory that is accessible to one or more processors of the system controller 18. In one or more embodiments, the harness model 204 comprises a two-dimensional model 204A that represents how certain points of interest must be arranged in relation to one another on the table 12. More particularly, the harness model 204 comprises a two dimensional point model 204A that defines the relative location of each of the wire routing pins 20 and each of the termination locations for the wiring harness. In one or more embodiments the two dimensional point model 204A may be contained in a .DXF file. Those skilled in the art will recognize that some harnesses can have multiple wire segments with co-located terminations. In one or more embodiments, the harness model 204 only needs to define a single termination location for each location where any one or more wire segments may be terminated. In the illustrated embodiment, the harness model further comprises a "cut list" 204B that defines the quantity of wire segments of a given wire type that must extend between the same two termination locations.

Figure 7:
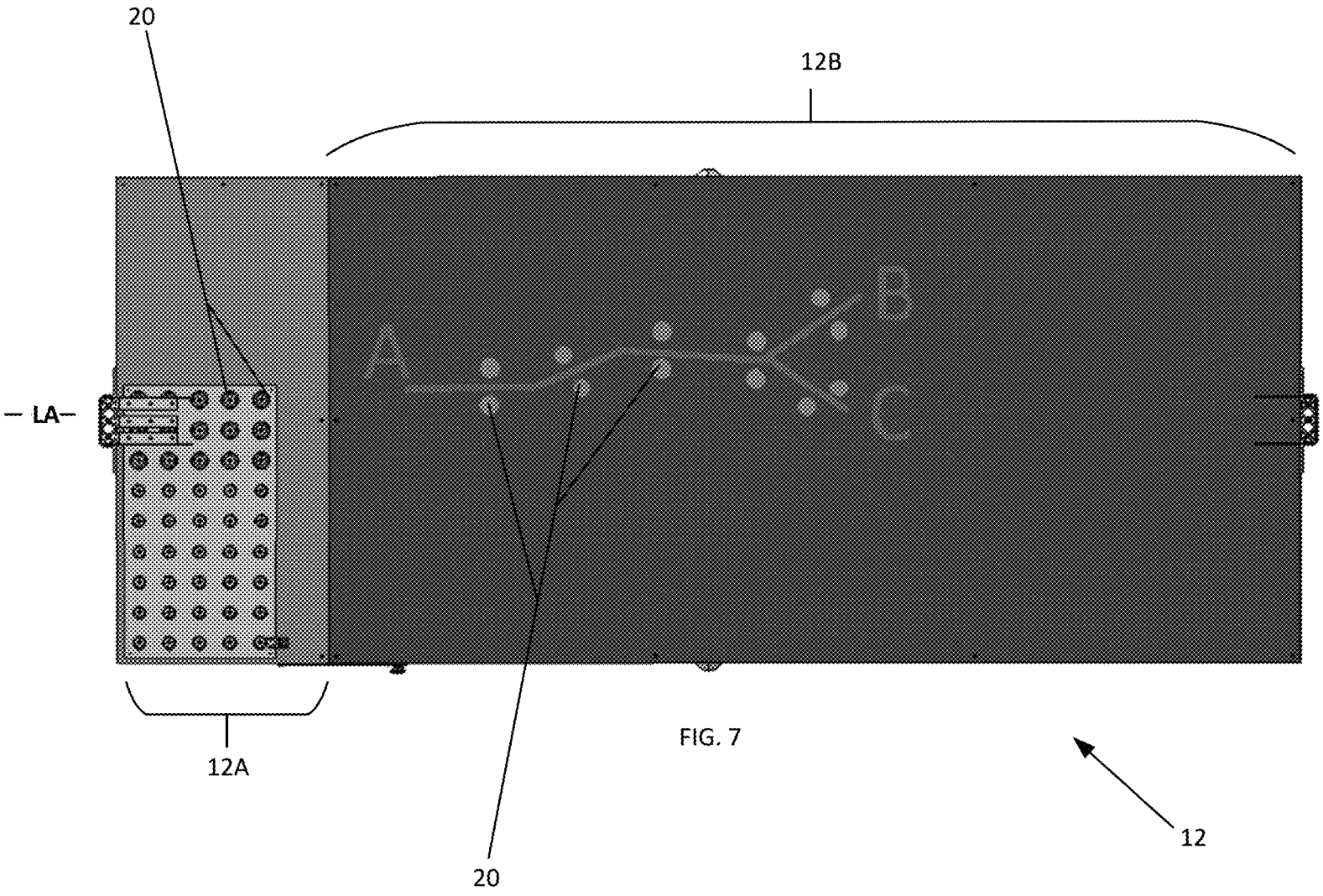
FIG. 7 is a top plan view of a table of the system illustrating a two-dimensional layout of points of interest on the table.
Figure 8:
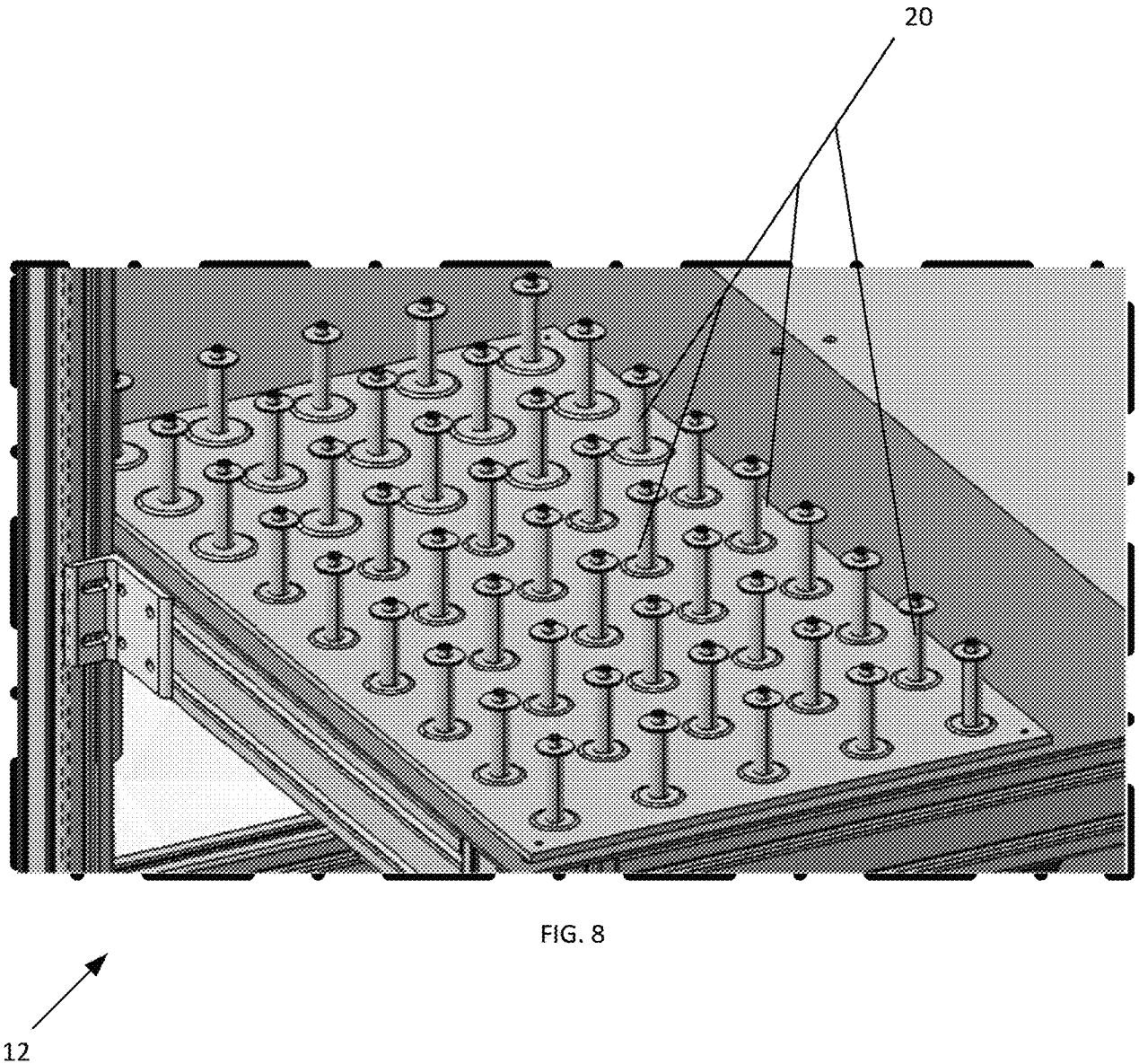
FIG. 8 is an enlarged perspective of a portion of the table.

An example of the information contained in a harness model 204 can be understood in reference to FIG. 7. Firstly, the harness model 204 comprises a two dimensional model 204A of the locations of each of the wire routing pins 20 and each of the harness termination locations A, B, C. For purposes of this example, assume a simple wiring harness that requires two types of wire, wire I and wire II. For purposes of example, a suitable harness model may comprise a cut list 204B that specifies that there are 14 segments of wire I that extend from termination point A to termination point B, 14 segments of wire I that extend from termination point A to termination point C, and six segments of wire II that extend from termination point B to termination point C.

In one or more embodiments, the layout automation engine 202 is configured to automatically, or by user selection, determine wire routes for each of the items in the cut list 204B relative to the wire routing pin locations defined in the two-dimensional model 204A. After determining the wire routes, the layout automation engine is configured to automatically configure the system controller 18 to direct the robotic arm 14 to position the wire routing pins 20 on the table 12 at the positions defined in the harness model and then, in coordination with the wire dispenser 16, make labeled and cut wire segments and route them through the pins to arrange a wiring harness on the table in accordance with the predefined wiring harness layout.

Figure 19:
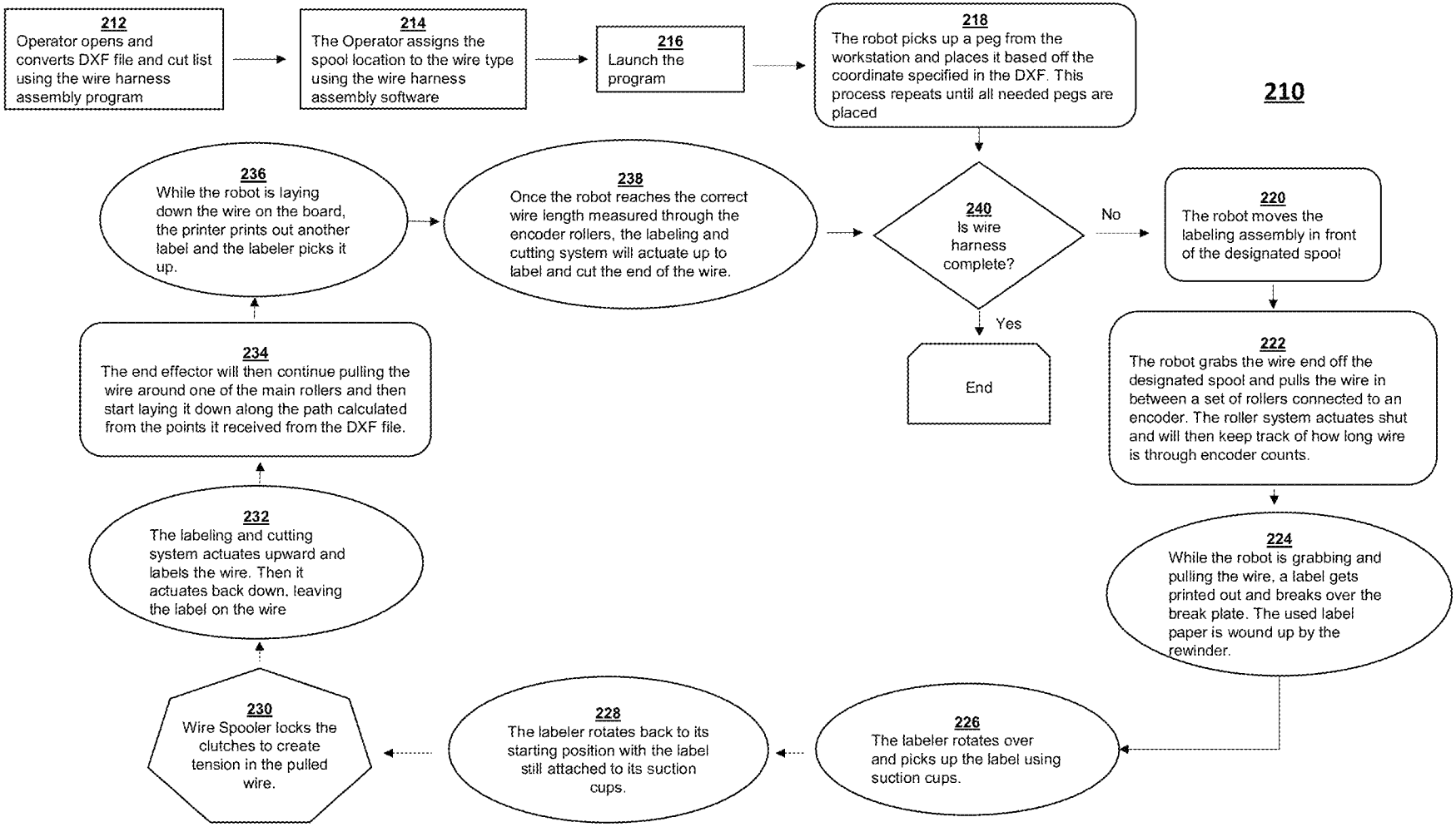
FIG. 19 is a flow chart schematically illustrating steps and a decision point in an exemplary method of using the robotic system to lay out a specified wiring harness.

Referring to FIG. 19, the steps and decision point in an exemplary process for laying out a wiring harness using the robotic system 10 is shown at reference number 210. In FIG. 19, steps performed by human operators are represented by rectangular boxes with square corners. Steps performed by the robotic arm 14 are indicated by rectangular boxes with rounded corners, steps performed by the wire segment preparation device 40 are indicated by ovals, and steps performed by the wire rack 30 are indicated by hexagon. Initially, at step 212, the operator provides the harness model 204 to the path planning engine 202. Then, at step 214, the operator assigns the spool location for each type of wire required for the wiring harness by loading the appropriate spools onto the rack 30 and inputting the corresponding information to the path planning engine 202. At step 216, the operator launches the path planning and execution engine 202, which causes the engine to determine the control routine that will be executed by the robotic system 10 to create the specified wire harness layout.

After the path planning is complete, at step 218 the system controller 18 directs the robotic arm to pick up a plurality of wire routing pins 20 from the preparation surface 12A and place them on the wire harness support surface 12B at the specified locations. Then, as shown in steps 220-240, the system controller 18 directs the robotic system 10 to prepare each wire segment defined in the harness model and place each prepared wire segment. The controller 18 suitably directs the following wire preparation sequence for each wire segment. First, the carriage driver 144 moves the carriage 44 to the position corresponding to the specified type of wire (step 220). Next, the robotic arm 14 pulls the end of the specified wire through the encoder 54 and the encoder closes on the wire as described above (step 222). Then the labeler 50 applies a first flag label to the leading end portion of the wire using the sequence of labeling operations described above (steps 224-232). The robotic arm 14 then pulls wire from the spool 31 until the encoder 54 outputs a signal indicating the required length of wire has been pulled (step 234). During this step, the robotic arm 214 moves the wire around a specified one of the calibration posts 23 and begins pulling the wire segment with respect to the wire routing pins 20 along the specified wire route. The labeler 50 then applies a second flag label to the trailing end portion of the wire using the sequence of labeling operations described above (steps 236-238). Finally, the wire cutter 52 cuts the wire to the defined length, leaving the trailing label attached to the cut segment of wire. The robotic arm 14 continues pulling the cut wire segment along the specified wire route until it is properly positioned, at which point the end effector 24 releases the wire segment. As shown at 240, this process of preparing and placing the wire segments is repeated until each wire segment in the wire harness has been placed on the table 12.

After the wiring harness is laid out in this fashion, the users can manually bundle the wire segments and connectorize the ends of the wire segments to complete the wiring harness. As can be seen, the robotic system 10 substantially automates the process of laying out a wiring harness. It is believed that automating the process can lead to fewer errors and more efficient processing, particularly in the case of bespoke wiring harness or wiring harnesses for apparatuses and systems that are manufactured in low production volumes.

In this disclosure, terms such as "actuator" or "driver" are used to generically describe movement devices that are capable of driving the defined movements. Unless otherwise specified in a way that clearly excludes the following possibilities, it is contemplated that the driver or actuator can comprise an electrically powered/electronically controlled mechanism such as a motor or a solenoid, a pneumatic mechanism including a pneumatic cylinder or motor, a hydraulic mechanism including a hydraulic cylinder or motor, or other suitable mechanisms.

Although described in connection with an exemplary computing system environment, embodiments of the aspects of the disclosure are operational with numerous other general purpose or special purpose computing system environments or configurations. The computing system environment is not intended to suggest any limitation as to the scope of use or functionality of any aspect of the disclosure. Moreover, the computing system environment should not be interpreted as having any dependency or requirement relating to any one or combination of components illustrated in the exemplary operating environment. Examples of well-known computing systems, environments, and/or configurations that may be suitable for use with aspects of the disclosure include, but are not limited to, personal computers, server computers, hand-held or laptop devices, multiprocessor systems, microprocessor-based systems, set top boxes, programmable consumer electronics, mobile telephones, network PCs, minicomputers, mainframe computers, distributed computing environments that include any of the above systems or devices, and the like.

Embodiments of the aspects of the disclosure may be described in the general context of data and/or processor-executable instructions, such as program modules, stored one or more tangible, non-transitory storage media and executed by one or more processors or other devices. Generally, program modules include, but are not limited to, routines, programs, objects, components, and data structures that perform particular tasks or implement particular abstract data types. Aspects of the disclosure may also be practiced in distributed computing environments where tasks are performed by remote processing devices that are linked through a communications network. In a distributed computing environment, program modules may be located in both local and remote storage media including memory storage devices.

In operation, processors, computers and/or servers may execute the processor-executable instructions (e.g., software, firmware, and/or hardware) such as those illustrated herein to implement aspects of the disclosure.

Embodiments of the aspects of the disclosure may be implemented with processor-executable instructions. The processor-executable instructions may be organized into one or more processor-executable components or modules on a tangible processor readable storage medium. Aspects of the disclosure may be implemented with any number and organization of such components or modules. For example, aspects of the disclosure are not limited to the specific processor-executable instructions or the specific components or modules illustrated in the figures and described herein. Other embodiments of the aspects of the disclosure may include different processor-executable instructions or components having more or less functionality than illustrated and described herein.

The order of execution or performance of the operations in embodiments of the aspects of the disclosure illustrated and described herein is not essential, unless otherwise specified. That is, the operations may be performed in any order, unless otherwise specified, and embodiments of the aspects of the disclosure may include additional or fewer operations than those disclosed herein. For example, it is contemplated that executing or performing a particular operation before, contemporaneously with, or after another operation is within the scope of aspects of the disclosure.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

In view of the above, it will be seen that the several objects of the invention are achieved and other advantageous results attained.

As various changes could be made in the above products and methods without departing from the scope of the invention, it is intended that all matter contained in the above description shall be interpreted as illustrative and not in a limiting sense.

What is claimed is:

1. A robotic system for laying out a wiring harness in a predefined wiring harness layout, the robotic system comprising:

a harness support surface comprising a ferromagnetic material;

a non-magnetic preparation surface adjacent the harness support surface;

a plurality of routing pins configured to be placed on the harness support surface;

a robotic arm including an end effector configured to arrange a plurality of wire segments along a specified wire route on the harness support surface;

the end effector comprising a gripper on the robotic arm, the gripper configured to selectively grip the routing pins so that the robotic arm can move the routing pins onto the harness support surface to define the specified wire route, and the gripper further configured to selectively grip wire segments so that the robotic arm can move the wire segments along the specified wire routes; and a system controller having one or more control processors configured to direct the robotic arm and the gripper to arrange the routing pins at specified locations along the harness support surface to define the specified wire routes and subsequently to direct the robotic arm and the gripper to move a plurality of wire segments onto the harness support surface along the specified wire routes.

2. The robotic system as set forth in claim 1, further comprising one or more pieces of ferromagnetic material defining the harness support surface.

3. The robotic system as set forth in claim 2, wherein the plurality of routing pins are configured to magnetically couple to the harness support surface when the magnetic routing pins are placed on the harness support surface.

4. The robotic system as set forth in claim 1, further comprising a wire dispenser including at least one spool of wire from which one or more of the plurality of wire segments may be cut.

5. The robotic system as set forth in claim 4, wherein the wire dispenser comprises a plurality of spools of wire of different types.

6. The robotic system as set forth in claim 5, wherein the wire dispenser has a grommet which holds a wire free end portion and wherein the grommet is configured to expose the free end portion of each of the plurality of spools of wire for being connected to the robotic arm.

7. The robotic system as set forth in claim 6, wherein the gripper is configured to grasp the free end portion of any of the plurality of spools of wire for unspooling the wire segment from the respective spool for use in the wiring harness.

8. The robotic system as set forth in claim 6, wherein the wire dispenser further comprises a wire segment preparation device including at least one of (i) a wire labeler and (ii) a wire cutter, the wire segment preparation device being configured to prepare each of the plurality of wire segments cut from one or more the plurality of spools of wire.

9. The robotic system as set forth in claim 8, wherein the wire dispenser holds the free end portions of the plurality of spools of wire at spaced apart locations along an axis, wherein the wire segment preparation device is movable along the axis to each of the plurality of spools of wire.

10. The robotic system as set forth in claim 4, wherein the wire dispenser further comprises a wire cutter configured to cut a wire segment from the spool of wire.

11. The robotic system as set forth in claim 4, wherein the wire dispenser further comprises a labeler configured to label the wire segment of the spool of wire.

12. The robotic system as set forth in claim 11, wherein the wire dispenser further comprises a wire cutter configured to cut a wire segment from the spool of wire.

13. The robotic system as set forth in claim 12, wherein the system controller is connected to the labeler and the spool of wire is configured to (i) direct the labeler to label a free end portion of the spool of wire, (ii) direct the robotic arm to unspool a predefined length of wire from the wire spool, (iii) direct the labeler to label a trailing end portion of the predefined length wire, and (iv) direct the wire cutter to cut the trailing end portion of the predefined length of wire to form the wire segment.

14. The robotic system as set forth in claim 5, wherein the wire dispenser further comprises an encoder.

15. The robotic system as set forth in claim 13, wherein the system controller is configured to direct the robotic arm and gripper to pull the free end portion of a selected one of the plurality of spools of wire through an encoder and wherein the encoder is configured to output a signal to the system controller indicating a length of wire that has been pulled through the encoder.

* * * * *